US009405219B2

(12) United States Patent
Watanabe

(10) Patent No.: US 9,405,219 B2
(45) Date of Patent: Aug. 2, 2016

(54) DEVELOPING DEVICE WITH REVERSE ROTATION CONTROL, IMAGE FORMING APPARATUS, AND METHOD FOR CONTROLLING DEVELOPING DEVICE

(71) Applicant: KYOCERA Document Solutions Inc., Osaka-shi, Osaka (JP)

(72) Inventor: Akihiro Watanabe, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/942,887

(22) Filed: Nov. 16, 2015

(65) Prior Publication Data

US 2016/0147172 A1 May 26, 2016

(30) Foreign Application Priority Data

Nov. 20, 2014 (JP) ..... 2014-235803

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01); *G03G 2215/0607* (2013.01)

(58) Field of Classification Search
CPC ..... G03G 15/0812; G03G 15/0808; G03G 15/0896; G03G 15/09; G03G 2215/0607; G03G 2215/0808
See application file for complete search history.

(56) References Cited

U.S. PATENT DOCUMENTS 7,603,066 B2 * 10/2009 Izumi ..... G03G 15/0921 399/272
2013/0216251 A1 * 8/2013 Watanabe ..... G03G 21/105 399/53
2014/0376973 A1 * 12/2014 Watanabe ..... G03G 15/0907 399/270

FOREIGN PATENT DOCUMENTS

JP 02226272 A * 9/1990
JP 05346731 A * 12/1993
JP 2009258276 A 11/2009

* cited by examiner

*Primary Examiner* — David Gray
*Assistant Examiner* — Laura Roth
(74) *Attorney, Agent, or Firm* — Alleman Hall McCoy Russell & Tuttle LLP

(57) ABSTRACT

A developing device 43 includes a first rotation control portion and a second rotation control portion. When a developing process is performed, the first rotation control portion causes a developer carrying member to rotate in a first rotation direction at a first rotation speed previously determined. When the developing process is not performed, the second rotation control portion causes the developer carrying member to rotate at a second rotation speed V2 faster than a rotation speed V1 during the developing process in a direction X2 reverse to a development rotation direction X1, and then, causes the developer carrying member to rotate at a third rotation speed V3 slower than the second rotation speed V2 in the direction X2.

7 Claims, 6 Drawing Sheets

DEVELOPING DEVICE WITH REVERSE ROTATION CONTROL, IMAGE FORMING APPARATUS, AND METHOD FOR CONTROLLING DEVELOPING DEVICE

INCORPORATION BY REFERENCE

This application is based upon and claims the benefit of priority from the corresponding Japanese Patent Application No. 2014-235803 filed on Nov. 20, 2014, the entire contents of which are incorporated herein by reference.

BACKGROUND

The present disclosure relates to a developing device which converts by electrophotography an electrostatic latent image into a manifest image, an image forming apparatus, and a method for controlling the developing device.

In general, in a developing device mounted in an image forming apparatus such as a multifunction peripheral, the thickness of the layer of a developer formed on the surface of a developer carrying member is regulated by a layer thickness regulating member. At this time, scattered toner accumulates on the surface of the layer thickness regulating member. If the accumulated toner is transferred from the layer thickness regulating member to a photosensitive member, the image quality of a printed matter may be adversely affected.

In order to address the above problem, there are cases where the following measures are taken. That is, in the image forming apparatus of this type, a magnetic brush is formed on the surface of the developer carrying member by the carrier in the developer including two components. By utilizing this, the image forming apparatus causes the developer carrying member to rotate in a direction reverse to the rotation direction during a developing process, thereby scraping the accumulated toner with the magnetic brush.

SUMMARY

A developing device according to one aspect of the present disclosure includes a developer carrying member, a first rotation control portion, a layer thickness regulating member, and a second rotation control portion. The developer carrying member is rotatably supported and is configured to rotate in a first rotation direction, thereby to carry a two-component developer on a surface thereof, to supply, at a first position, toner included in the two-component developer to a toner carrying member on a next stage, and further to cause the two-component developer carried on the surface to be detached therefrom at a second position on a downstream side in the first rotation direction relative to the first position. The first rotation control portion is configured to cause, when a developing process is performed, the developer carrying member to rotate in the first rotation direction at a first rotation speed previously determined. The layer thickness regulating member is provided, spaced from the surface of the developer carrying member, at a third position on an upstream side in the first rotation direction relative to the first position on an outer circumference of the developer carrying member, and is configured to regulate a thickness of a layer of the two-component developer carried by the developer carrying member rotating in the first rotation direction. The second rotation control portion is configured to, when the developing process is not performed, cause the developer carrying member to rotate at a second rotation speed faster than the first rotation speed in a second rotation direction reverse to the first rotation direction, and further cause the developer carrying member to rotate at a third rotation speed slower than the second rotation speed in the second rotation direction.

An image forming apparatus according to another aspect of the present disclosure includes a photosensitive member, a developing device, and a transfer portion. In the photosensitive member, an electrostatic latent image is formed on a surface thereof. The developing device is configured to supply the toner to the photosensitive member, to convert the electrostatic latent image into a toner image as a manifest image. The transfer portion is configured to transfer, to a recording sheet, the toner image formed on the photosensitive member.

A method for controlling a developing device according to another aspect of the present disclosure is a method for controlling a developing device including the developer carrying member and the regulation member, and includes two steps. In a first step, when a developing process is performed by the developer carrying member rotatably supported and configured to rotate in a first rotation direction, thereby to carry a two-component developer on a surface thereof, to supply, at a first position, toner included in the two-component developer to a toner carrying member on a next stage, and further to cause the two-component developer carried on the surface to be detached therefrom at a second position on a downstream side in the first rotation direction relative to the first position, the developer carrying member is caused to rotate in the first rotation direction at a first rotation speed previously determined. In a second step, when the developing process is not performed, the developer carrying member is caused to rotate at a second rotation speed faster than the first rotation speed in a second rotation direction reverse to the first rotation direction, and the developer carrying member is further caused to rotate at a third rotation speed slower than the second rotation speed in the second rotation direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described in detail based on the drawings. It should be noted that the following embodiments are examples embodying the present disclosure, and, by nature, do not limit the technical scope of the present disclosure.

Figure 1:
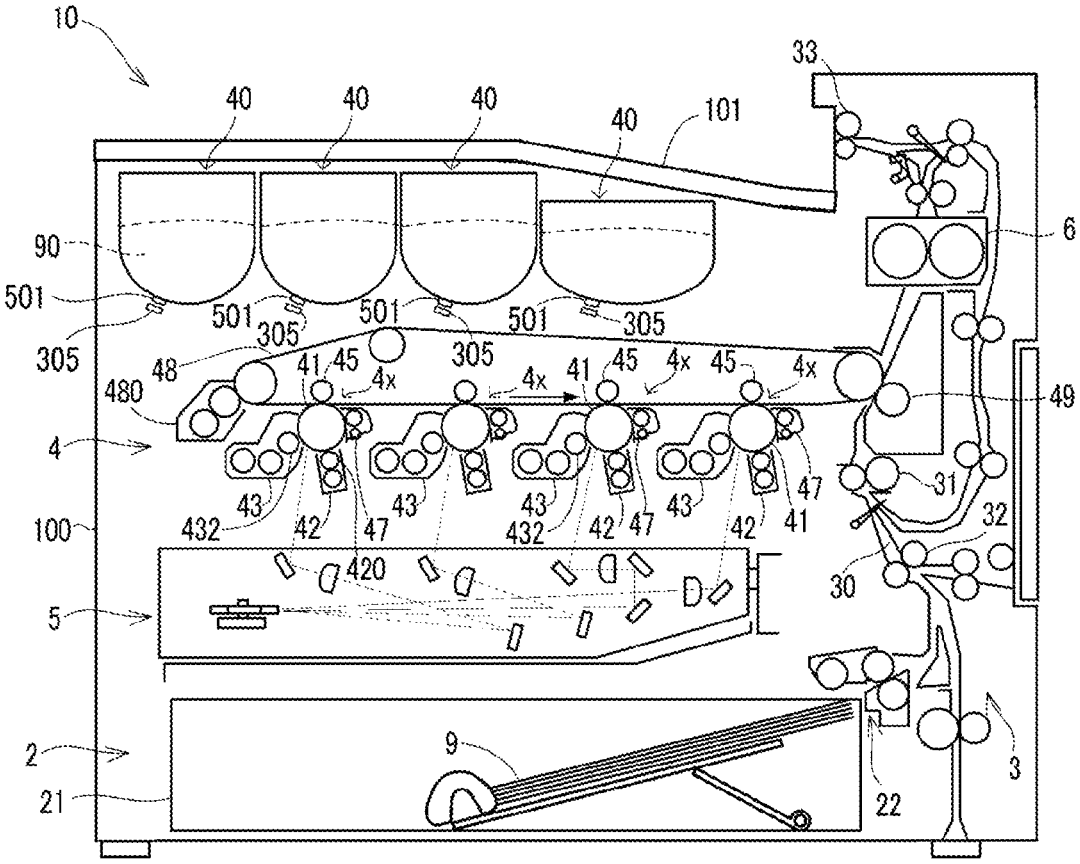
FIG. 1 is a configuration diagram of an image forming apparatus according to a first embodiment of the present disclosure.

First, with reference to FIGS. 1 and 2, a configuration of an image forming apparatus 10 according to a first embodiment of the present disclosure will be described. The image forming apparatus 10 is an electrophotographic image forming apparatus. As shown in FIG. 1, the image forming apparatus 10 includes a sheet feed portion 2, a sheet conveying portion 3, toner supply portions 40, an image forming portion 4, an optical scanning portion 5, a fixing portion 6, and the like in a housing 100.

The image forming apparatus 10 shown in FIG. 1 is a tandem type image forming apparatus, and is a color printer. Thus, the image forming portion 4 further includes an intermediate transfer belt 48, a secondary cleaning device 480, and a secondary transfer device 49.

The image forming portion 4 includes a plurality of single color image forming portions 4*x* respectively corresponding to colors of cyan, magenta, yellow, and black. Further, the image forming apparatus 10 includes a plurality of toner supply portions 40 which supply toners of colors of cyan, magenta, yellow, and black to later-described developer chambers 4300 (see FIG. 2) of later-described developing devices 43, respectively. Each toner supply portion 40 is removably mounted at a previously-determined position in the image forming apparatus 10. In the present embodiment, each toner supply portion 40 is mounted at an upper position in the image forming portion 4.

The image forming apparatus 10 is, for example, a printer, a copy machine, a facsimile machine, a multifunction peripheral, or the like. The multifunction peripheral also has the function of the printer, the function of the copy machine, and the like.

The sheet feed portion 2 includes a sheet receiving portion 21 and a sheet sending-out portion 22. The sheet receiving portion 21 is configured such that a plurality of recording sheets 9 can be placed thereon in a stacked manner. Each recording sheet 9 is a sheet-like medium on which an image is to be formed, such as paper, coated paper, a postcard, an envelope, an OHP sheet, or the like.

The sheet sending-out portion 22 rotates in contact with the recording sheet 9, to send out the recording sheet 9 from the sheet receiving portion 21 toward a conveying path 30.

The sheet conveying portion 3 includes registration rollers 31, conveying rollers 32, discharge rollers 33, and the like. The registration rollers 31 and the conveying rollers 32 convey the recording sheet 9 fed from the sheet feed portion 2, toward the secondary transfer device 49 of the image forming portion 4. Further, the discharge rollers 33 discharge the recording sheet 9 on which an image has been formed, from the discharge outlet of the conveying path 30 onto a discharge tray 101.

The intermediate transfer belt 48 is an endless belt-like member formed in a loop shape. The intermediate transfer belt 48 rotates in a state of being extended on and between two rollers. In the image forming portion 4, each single color image forming portion 4*x* forms an image of the color thereof on the surface of the intermediate transfer belt 48 which is rotating. Accordingly, a color image on which images in the respective colors are superposed is formed on the intermediate transfer belt 48.

The secondary transfer device 49 transfers, to the recording sheet 9, the toner image formed on the intermediate transfer belt 48. The secondary cleaning device 480 removes toner remaining on a portion, of the intermediate transfer belt 48, that has passed through the secondary transfer device 49.

Each single color image forming portion 4*x* includes a photosensitive drum 41 which carries a toner image, a charging device 42, a developing device 43, a primary transfer device 45, a primary cleaning device 47, and the like. Each photosensitive drum 41 is one example of a photosensitive member which carries a toner image while rotating. Each primary transfer device 45, the intermediate transfer belt 48, and the secondary transfer device 49 correspond to a transfer portion which transfers, to the recording sheet 9, the toner image formed on photosensitive drum 41.

Each photosensitive drum 41 rotates at a circumferential speed in accordance with the circumferential speed (movement speed) of the intermediate transfer belt 48. For example, it is conceivable that the photosensitive drum 41 is an organic photosensitive member. It is also conceivable that the photosensitive drum 41 is an amorphous silicon photosensitive member.

In each single color image forming portion 4*x*, the photosensitive drum 41 rotates, and the charging device 42 uniformly charges the surface of the photosensitive drum 41. Further, the optical scanning portion 5 performs scanning with laser light, thereby writing an electrostatic latent image on the charged surface of the photosensitive drum 41.

The developing device 43 develops the electrostatic latent image by supplying toner to the photosensitive drum 41. The developing device 43 in the present embodiment causes toner to be charged by agitating a two-component developer 90 including toner and carrier, and supplies the charged toner to the photosensitive drum 41.

The charging device 42 includes a charging roller 420 which charges a portion, of the photosensitive drum 41, on which the electrostatic latent image has not yet been written.

Figure 2:
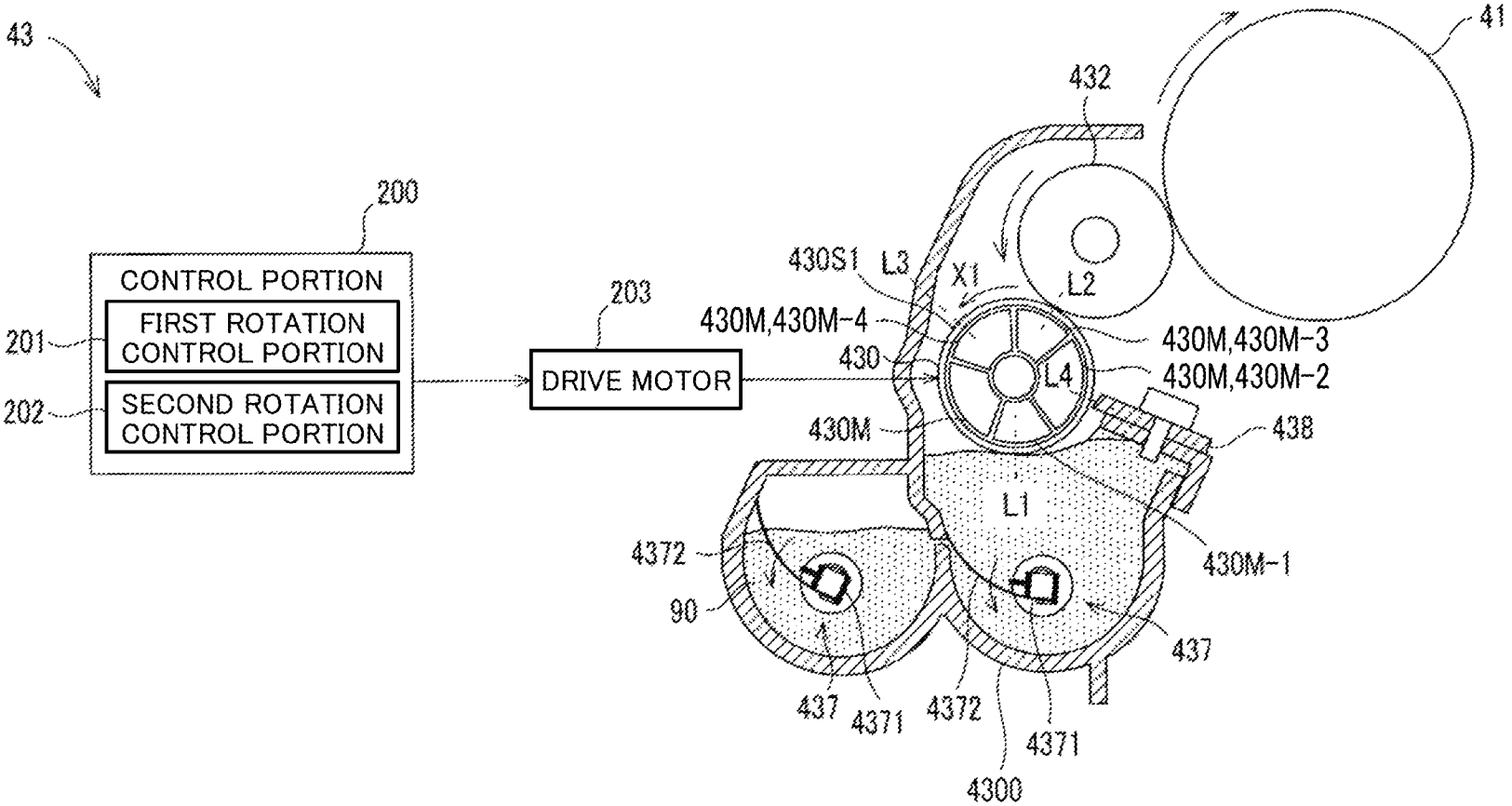
FIG. 2 is a configuration diagram of a photosensitive drum and a developing device in an image forming portion of the image forming apparatus according to the first embodiment of the present disclosure.

As shown in FIG. 2, each developing device 43 includes the developer chamber 4300, a magnetic roller 430, a developing roller 432, an agitation mechanism 437, and a blade 438. The magnetic roller 430, the developing roller 432, and the agitation mechanism 437 are rotatably supported about the rotation axes thereof which are parallel to one another.

The developer chamber 4300 contains the two-component developer including toner and carrier. The toner is supplied from its corresponding toner supply portion 40 (see FIG. 1). The toner is particles whose principal component is resin, and the carrier is particles including a magnetic material. The particle size of the toner is smaller than the particle size of the carrier. The toner is lighter in weight than the carrier. The magnetic material of the carrier is ferrite or the like, for example. As described later, the toner is agitated while being mixed with the carrier, thereby being charged with static electricity that occurs from friction between the toner and the carrier. With the presence of the carrier, in the two-component developer 90, the toner can be more easily charged, than in the case of a one-component developer consisting of toner alone, and thus, high quality of the image can be realized.

The agitation mechanism 437 is rotatably provided inside the developer chamber 4300. The agitation mechanism 437 agitates the two-component developer 90 in the developer chamber 4300.

The agitation mechanism 437 includes a rotation shaft portion 4371 and an agitating member 4372.

The rotation shaft portion 4371 is a shaft member formed in a shape that is long in a direction orthogonal to the drawing plane of FIG. 2. The rotation shaft portion 4371 is rotatably supported by side walls (not shown) at opposite ends in the direction orthogonal to the drawing plane of FIG. 2 of the developer chamber 4300.

The agitating member 4372 is a flexible member formed in a film shape. For example, the agitating member 4372 is a member including synthetic resin such as a PET (polyethylene terephthalate) resin. The principal material of the agitating member 4372 is not limited to a PET resin, and may be a synthetic resin such as vinyl chloride, polycarbonate, or the like.

The agitating member 4372 is attached to the rotation shaft portion 4371. The agitating member 4372 is formed so as to extend along the longitudinal direction of the rotation shaft portion 4371 and so as to extend from the rotation shaft portion 4371 in a direction that crosses the longitudinal direction of the rotation shaft portion 4371. In the present embodiment, the rotation shaft portion 4371 has a planar adhesion surface (not shown). An edge portion of the agitating member 4372 is bonded with an adhesive to the adhesion surface of the rotation shaft portion 4371.

The agitating member 4372 rotates in conjunction with rotation of the rotation shaft portion 4371, to move in the two-component developer 90 in the developer chamber 4300. Accordingly, the two-component developer 90 in the developer chamber 4300 is agitated. This agitation causes friction between the toner and the carrier, and the toner is charged with static electricity caused by this friction, to a previously-determined polarity. The carrier is charged to a polarity opposite to the polarity to which the toner is charged. Then, the toner adheres to the carrier under static electricity.

The magnetic roller 430 is rotatably provided inside the developer chamber 4300. The magnetic roller 430 attracts the two-component developer 90 agitated by the agitation mechanism 437, from the developer chamber 4300 with magnetic force thereof, and carries the two-component developer 90 on the surface of the magnetic roller 430.

The magnetic roller 430 includes a sleeve portion 430S1 and magnets 430M.

The sleeve portion 430S1 has a cylindrical shape, and holds the magnets 430M therein. The sleeve portion 430S1 is composed of a nonmagnetic member. The sleeve portion 430S1 is rotatable in forward/reverse directions. The sleeve portion 430S1 rotates in one direction during a developing process. In the description below, the rotation direction of the sleeve portion 430S1 during the developing process will be referred to as a development rotation direction X1. The development rotation direction X1 corresponds to a first rotation direction. In the present embodiment, the development rotation direction X1 is a counterclockwise direction on the drawing of FIG. 2.

A plurality of magnets 430M are provided inside the sleeve portion 430S1. The plurality of magnets 430M are arranged with a predetermined interval therebetween along the circumferential direction. The positions of the magnets 430M are fixed in the sleeve portion 430S1. The plurality of magnets 430M include a magnet 430M-1, a magnet 430M-2, a magnet 430M-3, and a magnet 430M-4.

The magnet 430M-1 is provided at a position opposed to the two-component developer 90 in the developer chamber 4300. The magnet 430M-1 attracts the two-component developer 90 contained in the developer chamber 4300. Accordingly, the two-component developer 90 adheres to the portion opposed to the magnet 430M-1 of the surface of the sleeve portion 430S1 in the magnetic roller 430. A position L1 shown in FIG. 2 indicates a developer transfer position L1 at which the two-component developer 90 contained in the developer chamber 4300 is transferred to the sleeve portion 430S1.

The magnet 430M-2 is provided at a position adjacent to the magnet 430M-1 and on the downstream side in the development rotation direction X1 relative to the magnet 430M-1. The magnet 430M-2 causes the sleeve portion 430S1 to carry the two-component developer 90.

Under the magnetic force of the magnet 430M-1 and the magnet 430M-2, a developer layer is formed on the surface of the sleeve portion 430S1. On this developer layer, a magnetic brush B1 (see FIG. 4) is formed. In the present embodiment, the sleeve portion 430S1 of the magnetic roller 430 is one example of the developer carrying member which carries the two-component developer 90.

The magnetic brush B1 is formed in the following manner: a plurality of carrier particles included in the two-component developer 90 are connected together to form a plurality of ページ : 10
chains on the surface of the magnetic roller 430 under the magnetic force of the magnets 430M-1 and 430M-2, resulting in a stack of the chains of carrier particles.

Each of the magnetic roller 430 and the developing roller 432 has bias applied thereon, and a previously-determined potential difference is provided between the magnetic roller 430 and the developing roller 432. Due to this potential difference, the toner included in the two-component developer 90 carried by the magnetic roller 430 is transferred to the developing roller 432. A position L2 shown in FIG. 2 indicates a toner transfer position L2 at which the toner included in the two-component developer 90 carried by the magnetic roller 430 is transferred to the developing roller 432. The toner transfer position L2 corresponds to a first position.

As described above, the magnetic roller 430 is rotatably supported in the developer chamber 4300 and rotates in the development rotation direction X1, thereby carrying the two-component developer 90 on the surface thereof and supplying, at the toner transfer position L2, the toner included in the two-component developer 90 to the developing roller 432 on the next stage.

The magnet 430M-3 is provided at a position opposed to the developing roller 432, and attracts, to the sleeve portion 430S1, the carrier remaining on the magnetic roller 430 as a result of the toner having been transferred to the developing roller 432 at the toner transfer position L2. The carrier attracted to the sleeve portion 430S1 by the magnet 430M-3 keeps the state where the magnetic brush B1 is formed.

After the toner has been transferred to the developing roller 432 at the toner transfer position L2, the magnet 430M-4 separates, from the surface of the magnetic roller 430, the carrier remaining on the surface with the magnetic force thereof, and causes the carrier to drop into the developer chamber 4300 located below. A position L3 shown in FIG. 2 indicates a separation position L3 at which the carrier remaining on the surface of the magnetic roller 430 is separated from the surface with the magnetic force. The separation position L3 corresponds to a second position.

During the developing process, the magnetic roller 430 receives the two-component developer 90 from the developer chamber 4300 at the developer transfer position L1 with the magnetic force of the magnet 430M-1, and conveys the two-component developer 90 through rotation of the sleeve portion 430S1 in the development rotation direction X1. When the two-component developer 90 has been conveyed to the toner transfer position L2, the toner included in the two-component developer 90 is transferred to the developing roller 432 on the next stage, due to the potential difference between the magnetic roller 430 and the developing roller 432. At this time, the carrier remains on the surface of the magnetic roller 430.

The magnetic roller 430 conveys the carrier to the separation position L3 through further rotation of the sleeve portion 430S1 in the development rotation direction X1. When having conveyed the carrier to the separation position L3, the magnetic roller 430 causes the carrier to be detached from the magnetic roller 430, with repulsive force acting between the carrier and the magnet 430M-4. Accordingly, the separated carrier drops into the developer chamber 4300 located below.

The blade 438 is provided, spaced from the surface of the magnetic roller 430, at a layer thickness regulation position L4 on the upstream side in the development rotation direction X1 relative to the toner transfer position L2 on the outer circumference of the magnetic roller 430. The blade 438 regulates the thickness of the layer of the two-component developer 90 carried by the magnetic roller 430 rotating in the development rotation direction X1. The blade 438 is one example of a layer thickness regulating member. The layer thickness regulation position L4 corresponds to a third position. In the present embodiment, the separation position L3 and the layer thickness regulation position L4 are arranged at positions substantially opposite to each other relative to the rotation axis of the magnetic roller 430.

The developing roller 432 receives, from the magnetic roller 430, the toner included in the two-component developer 90 carried by the magnetic roller 430. On the surface of the developing roller 432, a toner layer is formed from the toner.

The developing roller 432 faces the photosensitive drum 41 in a non-contact state. Due to the bias applied to the developing roller 432, the toner on the developing roller 432 is transferred to the portion of the electrostatic latent image formed on the outer circumferential surface of the photosensitive drum 41. That is, the developing roller 432 converts the electrostatic latent image into a manifest image, by supplying the toner to the photosensitive drum 41 in which the electrostatic latent image is formed on the surface thereof. The developing roller 432 is one example of a toner carrying member.

The developing roller 432 rotates in the same direction as that of the magnetic roller 430 during the developing process. Accordingly, the portions, of the outer circumferential surfaces of the magnetic roller 430 and the developing roller 432, that face each other move in reverse directions, respectively.

In addition, during the developing process, the developing roller 432 and the photosensitive drum 41 rotate in reverse directions with each other. Accordingly, the portions, of the outer circumferential surfaces of the developing roller 432 and the photosensitive drum 41, that face each other move in the same direction.

In this manner, the toner included in the two-component developer 90 is consumed during the developing process. Thus, the toner is supplied from the toner supply portion 40 into the developer chamber 4300, to supplement the consumed amount. On the other hand, the carrier included in the two-component developer 90 will remain in the developer chamber 4300 with scarcely being consumed, and provides flowability and the like to the toner supplied to the developer chamber 4300.

The developing device 43 includes a drive motor 203. The drive motor 203 drives the magnetic roller 430 so as to rotate. It is conceivable that the drive motor 203 is a DC brushless motor, a stepping motor, or the like.

The developing device 43 includes a control portion 200. The control portion 200 includes a CPU (Central Processing Unit), a ROM (Read Only Memory), and a RAM (Random Access Memory).

The CPU is a processor that executes various kinds of calculation processes. The ROM is a nonvolatile storage portion in which information such as a control program for causing the CPU to execute various kinds of processes is previously stored. The RAM is a volatile storage portion to be used as a temporary storage memory (working area) for various kinds of processes executed by the CPU. The control portion 200 controls operation of the image forming apparatus 10, by the CPU executing the program stored in the ROM.

Figure 5:
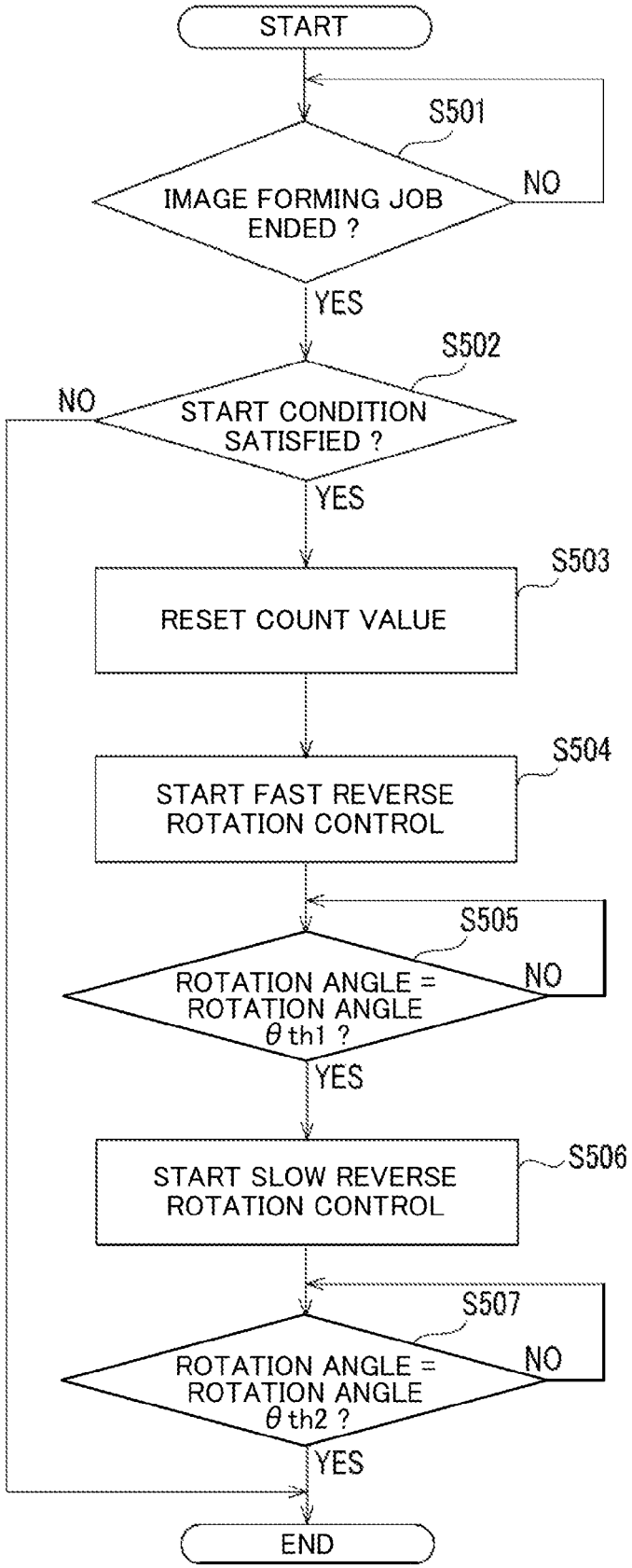
FIG. 5 is a flow chart showing a process performed by a control portion.

In the ROM of the control portion 200, a processing program is stored which causes the CPU of the control portion 200 to execute a process described later (see the flow chart in FIG. 5). The processing program may be stored in the ROM at the time of shipment of the image forming apparatus 10. Alternatively, the processing program may be stored in a computer-readable information storage medium such as a CD (Compact Disc), a DVD (Digital Versatile Disc), or a flash memory, and after the shipment, the processing program may be stored in the ROM of the control portion 200 from the information storage medium. It is also conceivable as another embodiment that part or a plurality of functions of the control portion 200 are implemented as electronic circuits.

Figure 3:
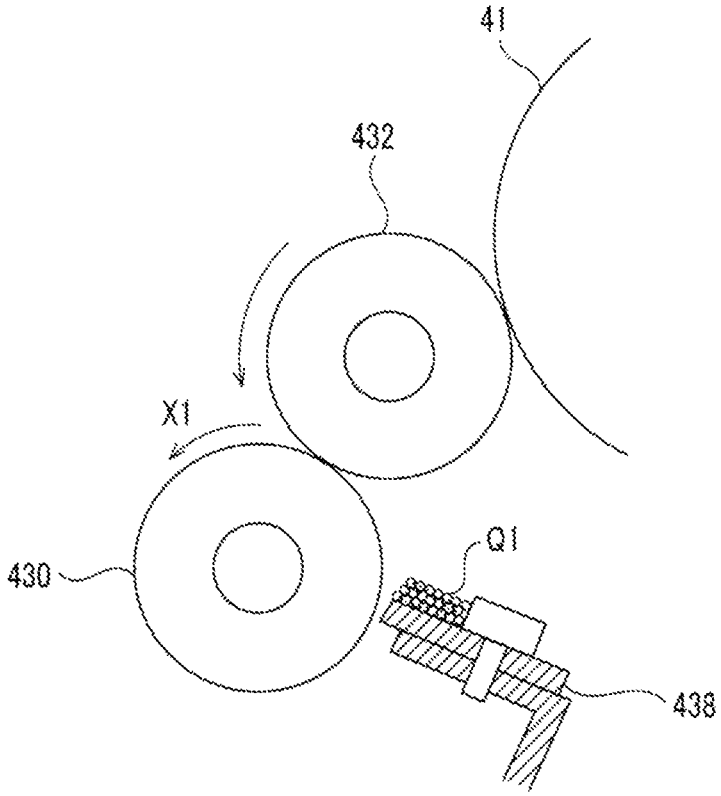
FIG. 3 shows a state in which toner is accumulated on the surface of a blade.

Meanwhile, in the developing device 43, toner scattered when the thickness of the layer of the developer on the magnetic roller 430 is regulated by the blade 438 accumulates on the surface of the blade 438 (see FIG. 3). When the size of the accumulated toner Q1 has become large, there is a risk that the accumulated toner is transferred from the blade 438, via the developing roller 432, to the photosensitive drum 41, thereby adversely affecting the image quality.

Figure 4A:
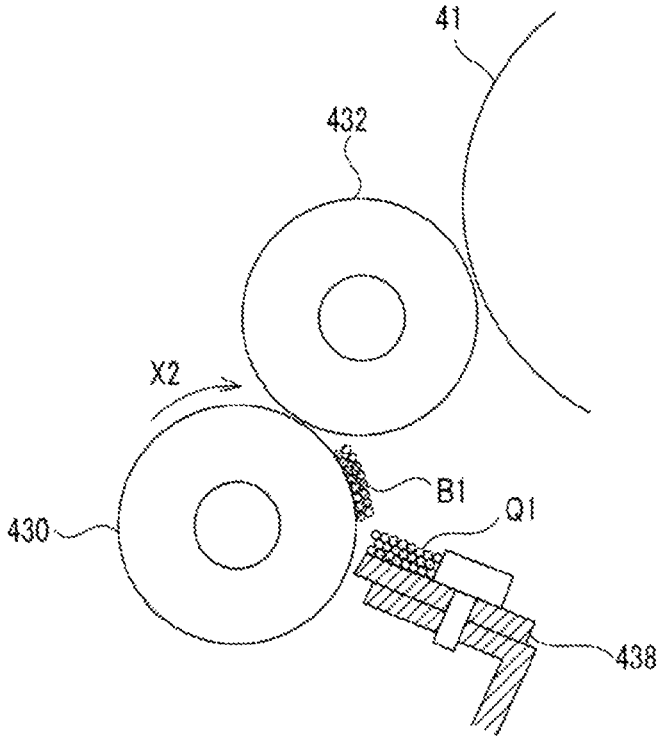
FIG. 4A shows a state in which a magnetic roller is in reverse rotation.
Figure 4B:
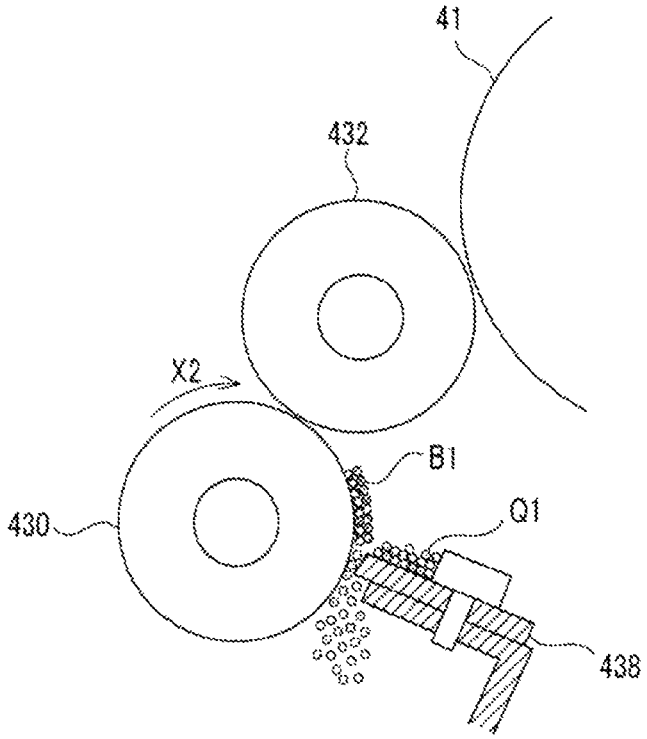
FIG. 4B shows a state in which, through reverse rotation of the magnetic roller, a magnetic brush scrapes toner accumulated on the surface of the blade.

In order to address the above problem, there are cases where, by utilizing the phenomenon that the magnetic brush B1 is formed on the surface of the developer carrying member by the carrier included in the two-component developer 90, the accumulated toner is scraped by the magnetic brush B1 (see FIG. 4B) by rotating the magnetic roller 430 in a rotation direction X2, which is reverse (hereinafter, referred to as reverse rotation direction) to the rotation direction during the developing process (see FIG. 4A).

However, in the case where the control is performed in which the magnetic roller 430 is rotated in the reverse rotation direction X2 to the rotation direction during the developing process, there is a demand for a technique that enhances the performance of removing the accumulated toner from the surface of the blade 438. Thus, the present embodiment includes the following configuration.

In the present embodiment, the control portion 200 includes a first rotation control portion 201 and a second rotation control portion 202.

During the developing process, the first rotation control portion 201 performs forward rotation control of causing the magnetic roller 430 to rotate in the development rotation direction X1 at a first rotation speed V1 previously determined.

When the developing process is not performed, the second rotation control portion 202 performs reverse rotation control of causing the magnetic roller 430 to rotate in the reverse rotation direction X2 to the development rotation direction X1. Here, in the reverse rotation control, the second rotation control portion 202 causes the magnetic roller 430 to rotate at a second rotation speed V2 which is faster than the first rotation speed V1, and then, causes the magnetic roller 430 to rotate at a third rotation speed V3 which is slower than the second rotation speed V2 in the reverse rotation direction X2. The reverse rotation direction X2 corresponds to a second rotation direction.

The rotation angle by which the magnetic roller 430 is rotated at the second rotation speed V2 is greater than or equal to the rotation angle from the separation position L3 to the layer thickness regulation position L4 in the reverse rotation direction X2, and less than the angle corresponding to one rotation.

The toner removing performance obtained through reverse rotation of the magnetic roller 430 is higher in the case where the third rotation speed V3 is less than the first rotation speed V1, than in the case where the third rotation speed V3 is greater than or equal to the first rotation speed V1. Thus, it is conceivable that the third rotation speed V3 is slower than the first rotation speed V1.

In the description below, the control in which the second rotation control portion 202 causes the magnetic roller 430 to rotate at the second rotation speed V2 in the reverse rotation direction X2 will be referred to as fast reverse rotation control, and the control in which the second rotation control portion 202 causes the magnetic roller 430 to rotate at the third rotation speed V3 in the reverse rotation direction X2 will be referred to as slow reverse rotation control.

Next, with reference to FIG. 5, the process performed by the control portion 200 will be described. In the flow chart shown in FIG. 5, steps S501, S502, . . . represent the numbers of steps in the processing procedure. The process by the control portion 200 shown in FIG. 5 is started at the time when an image forming job involving the developing process is executed.

<Step S501>

In step S501, the control portion 200 determines whether an image forming job has ended. When determining that the image forming job has not ended (NO in step S501), the control portion 200 executes the process of step S501 again. On the other hand, when determining that the image forming job has ended (YES in step S501), the control portion 200 advances the process to step S502.

<Step S502>

Upon determining that the image forming job has ended, the control portion 200 determines whether a start condition on which to start the reverse rotation control of the magnetic roller 430 has been satisfied. As the start condition, for example, a condition can be employed that the count value of a counter (not shown) described later has exceeded a value indicating the number of sheets previously determined. The value is 10000, for example.

When determining that the start condition has not been satisfied (NO in step S502), the control portion 200 ends the process. On the other hand, when determining that the start condition has been satisfied (YES in step S502), the control portion 200 advances the process to step S503.

<Step S503>

In step S503, the control portion 200 resets the count value of the counter. The counter counts the number of recording sheets 9 on which image forming has been performed. It is conceivable that the counter is provided in the control portion 200. After executing the process of step S503, the control portion 200 advances the process to step S504.

<Step S504>

In step S504, the control portion 200 starts the fast reverse rotation control on the magnetic roller 430. Under this fast reverse rotation control, the two-component developer 90 attracted on the magnetic roller 430 under the magnetic force of the magnet 430M slips on the surface of the magnetic roller 430. In other words, the control portion 200 causes the magnetic roller 430 to rotate at the second rotation speed V2 that causes the two-component developer 90 to slip on the surface of the magnetic roller 430.

As a result of the slipping, the magnetic brush B1 is gathered, forming a lump of the magnetic brush B1. After executing the process of step S504, the control portion 200 advances the process to step S505.

<Step S505>

The control portion 200 determines whether the rotation time period under the fast reverse rotation control on the magnetic roller 430 has reached a rotation time period Tth1 previously determined. The rotation time period for the magnetic roller 430 is set so as to attain an intended rotation angle. It is conceivable that the rotation time period Tth1 is, for example, a time period required for the magnetic roller 430 to rotate by an angle from the separation position L3 to the layer thickness regulation position L4 in the reverse rotation direction X2.

When determining that the rotation time period has not reached the rotation time period Tth1 (NO in step S505), the control portion 200 executes the process of step S505 again. On the other hand, when determining that the rotation time period has reached the rotation time period Tth1 (YES in step S505), the control portion 200 advances the process to step S506.

Here, the fast reverse rotation control is ended when the rotation time period has reached the rotation time period Tth1, but a mode is also conceivable in which: a sensor is provided which detects that the reverse rotation angle has reached the intended angle; and the fast reverse rotation control is ended depending on the detection result from the sensor.

The carrier carried on the surface of the magnetic roller 430 is detached from the surface at the separation position L3. Accordingly, the carrier is scarcely present on the surface of the magnetic roller 430 from the separation position L3 to the developer transfer position L1 in the development rotation direction X1. Thus, even if the magnetic roller 430 is caused to reversely rotate by an angle greater than or equal to the rotation angle from the separation position L3 to the layer thickness regulation position L4, the size of the lump of the magnetic brush B1 formed as a result of the slipping hardly changes.

In order to avoid delay of the start of execution of an image forming job that could be newly generated, the time period required for the reverse rotation control is preferably as short as possible.

From the above, in the present embodiment, when the magnetic roller 430 is caused to reversely rotate at the fast speed by an angle from the separation position L3 to the layer thickness regulation position L4 in the reverse rotation direction X2, the toner accumulated on the surface of the blade 438 can be efficiently removed by the magnetic brush B1 in a short time. However, the rotation angle when causing the magnetic roller 430 to reversely rotate at the fast speed is not limited to the rotation angle from the separation position L3 to the layer thickness regulation position L4 in the reverse rotation direction X2.

<Step S506>

When determining that the rotation angle has reached the previously determined rotation angle, the control portion 200 starts the slow reverse rotation control on the magnetic roller 430. Under this slow reverse rotation control, the two-component developer 90 carried on the surface of the magnetic roller 430 does not slip on the surface of the magnetic roller 430, and the lump of the magnetic brush B1 formed under the fast reverse rotation control advances toward the surface of the blade 438.

Then, the lump of the magnetic brush B1 hits the toner accumulated on the surface of the blade 438, thereby scraping the toner from the surface of the blade 438. The scraped toner passes through the gap between the surface of the magnetic roller 430 and the tip of the blade 438, and drops toward the developer chamber 4300.

By the slow reverse rotation control being performed after the fast reverse rotation control, the lump of the magnetic brush B1 hits the accumulated toner on the surface of the blade 438. In this case, the performance of removing the toner accumulated on the surface of the blade 438 is improved compared with a case where the magnetic brush B1 not having gathered hits the accumulated toner. After executing the process of step S506, the control portion 200 advances the process to step S507.

<Step S507>

The control portion 200 determines whether the rotation angle under the slow reverse rotation control on the magnetic roller 430 has reached a rotation time period Tth2 previously determined. When determining that the rotation angle has not reached the rotation time period Tth2 (NO in step S507), the control portion 200 executes the process of step S507 again.

On the other hand, when determining that the rotation angle has reached the rotation time period Tth2 (YES in step S507), the control portion 200 ends the reverse rotation control. When the sum of the rotation amount corresponding to the rotation time period Tth1 and the rotation amount corresponding to the rotation time period Tth2 is greater than or equal to an amount corresponding to one rotation at least, particularly excellent toner removing performance can be obtained.

Figure 6:
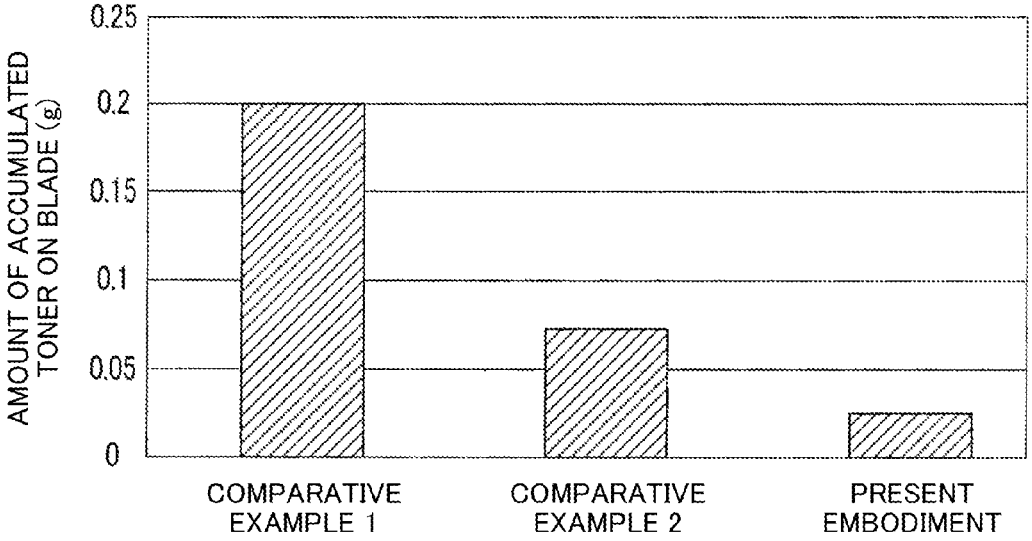
FIG. 6 shows a result of verification of the effect of the present embodiment.

FIG. 6 shows a result of a test verifying the effect of the present embodiment. FIG. 6 shows a result of a verification test in which the amounts of toner accumulated on the blade 438 are compared among the present embodiment and two patterns of Comparative examples 1 and 2.

In the verification test, measured is the amount of toner accumulated on the surface of the blade 438 when an image has been formed on 10000 recording sheets 9 at the image coverage rate of 5%. The diameter of the magnetic roller 430 is 16 mm, the diameter of the developing roller is 16 mm, and the value of the rotation speed of the developing roller in terms of circumferential speed is 208 mm/sec.

Comparative example 1 is an example case in which the reverse rotation control on the magnetic roller 430 is not performed. Comparative example 2 is an example case in which: the magnetic roller 430 is caused to reversely rotate when image formation is not performed; but the rotation speed at that time is the same as the rotation speed during the developing process. The rotation speed (the first rotation speed V1) of the magnetic roller 430 during the developing process in terms of circumferential speed is 235 mm/sec.

In the present embodiment, the value of the second rotation speed V2 under the fast reverse rotation control in terms of circumferential speed and the rotation amount corresponding to the rotation time period Tth1 are 470 mm/sec and 180 degrees, respectively. Further, in the present embodiment, the value of the third rotation speed V3 under the slow reverse rotation control in terms of circumferential speed and the rotation amount corresponding to the rotation time period Tth2 are 118 mm/sec and 360 degrees, respectively. At the time point when the magnetic roller 430 has been driven to rotate by one round after the slow reverse rotation control had been started on the magnetic roller 430, the drive is stopped.

As shown in FIG. 6, when Comparative example 1 is compared with Comparative example 2, the amount of accumulated toner is 0.2 g in Comparative example 1, whereas, in Comparative example 2, the amount of accumulated toner is 0.07 g, reducing the amount of accumulated toner to about ⅓.

When the present embodiment is compared with Comparative example 2, an experimental result has been obtained in which, in the present embodiment, the amount of accumulated toner has been reduced to 0.025 g, which is about ⅓ of the amount of accumulated toner in Comparative example 2.

As described above, in the present embodiment, compared with a case where the magnetic roller 430 is caused to reversely rotate at a constant speed, the amount of toner accumulated on the surface of the blade 438 can be further reduced.

A preferred embodiment of the present disclosure has been described above. However, the present disclosure is not limited to the above embodiment, and various modifications can be made.

(1) The developing device 43 according to the embodiment is a device that develops an electrostatic latent image on the surface of the photosensitive drum 41 by a so-called interactive touch-down system. However, the developing device mounted in the image forming apparatus 10 is not limited thereto.

That is, the developing device mounted in the image forming apparatus 10 may be a developing device of a type that does not include the magnetic roller 430, and in which the developing roller 432 receives the two-component developer 90 contained in the developer chamber 4300 and supplies the toner to the photosensitive drum 41. In this case, the developing roller 432 corresponds to the developer carrying member which carries the agitated two-component developer 90, and the photosensitive drum 41 corresponds to the toner carrying member.

(2) The toner is charged through friction with the carrier caused by agitation by the magnetic roller 430. As the charged toner is left to stand, the electric charge is discharged from the toner with the elapse of time. This phenomenon is referred to as charge decay, electrostatic diffusion, or the like. The charge decay characteristic of the toner, that is, the discharging speed of electric charge, is different depending on the kind of the toner. The developing device 43 can be loaded with any of various kinds of toner having different charge decay speeds.

Toner having a fast charge decay speed is more likely to scatter to the surroundings than toner having a slow charge decay speed. Thus, when the developing device 43 is loaded with the toner having a fast charge decay speed, a large lump of accumulated toner is more likely to be formed on the surface of the blade 438. In this case, unless the reverse rotation amount of the magnetic roller 430 is increased in accordance with increase in the size of the accumulated toner, the accumulated toner cannot be sufficiently removed from the blade 438.

Thus, the rotation angle (rotation amount) in at least one of the fast reverse rotation and the slow reverse rotation may be set in accordance with the charge decay speed of the toner loaded into the developing device 43.

That is, the developing device 43 includes an obtaining portion and a reverse rotation amount setting portion described below.

The obtaining portion obtains toner information regarding the charge decay characteristic of the toner contained in the toner supply portion 40. The toner supply portion 40 is provided with an information storage medium retaining the toner information therein. The obtaining portion can read the toner information from the information storage medium.

The reverse rotation amount setting portion sets the reverse rotation amount of the magnetic roller 430 such that, in the case where the charge decay speed of the toner is high, the reverse rotation amount of the magnetic roller 430 is increased compared with that in the case where the charge decay speed is low. Specifically, the reverse rotation amount setting portion sets the reverse rotation amount of the magnetic roller 430 based on the charge decay characteristic of the toner indicated by the toner information. The reverse rotation amount is a rotation amount in at least one of the fast reverse rotation and the slow reverse rotation.

When the developing process is not performed, the second rotation control portion 202 causes the magnetic roller 430 to reversely rotate by the reverse rotation amount set by the reverse rotation amount setting portion.

Accordingly, the operation of removing the toner accumulated on the blade 438 can be performed, by a proper amount, in accordance with the charge decay speed of the toner. The configuration described above is effective in particular for a developing device in which the separation position L3 is not set in the magnetic roller 430.

(3) When the reverse rotation control by the second rotation control portion 202 has ended, the first rotation control portion 201 may cause the magnetic roller 430 to previously rotate in the development rotation direction X1, so as to be ready for generation of another image forming job. Accordingly, when another image forming job has been generated, a developer layer has been formed on the surface of the magnetic roller 430, and thus, the image forming job that has been generated can be quickly executed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer carrying member rotatably supported and configured to rotate in a first rotation direction, thereby to carry a two-component developer on a surface thereof, to supply, at a first position, toner included in the two-component developer to a toner carrying member on a next stage, and further to cause the two-component developer carried on the surface to be detached therefrom at a second position on a downstream side in the first rotation direction relative to the first position;

a first rotation control portion configured to cause, when a developing process is performed, the developer carrying member to rotate in the first rotation direction at a first rotation speed previously determined;

a layer thickness regulating member provided, spaced from the surface of the developer carrying member, at a third position on an upstream side in the first rotation direction relative to the first position on an outer circumference of the developer carrying member, the layer thickness regulating member configured to regulate a thickness of a layer of the two-component developer carried by the developer carrying member rotating in the first rotation direction; and a second rotation control portion configured to, when the developing process is not performed, cause the developer carrying member to rotate at a second rotation speed faster than the first rotation speed in a second rotation direction reverse to the first rotation direction, and further cause the developer carrying member to rotate at a third rotation speed slower than the second rotation speed in the second rotation direction.

2. The developing device according to claim 1, wherein the second rotation control portion causes the developer carrying member to rotate by a first rotation angle less than an angle corresponding to one rotation at the second rotation speed in the second rotation direction, and then causes the developer carrying member to rotate at the third rotation speed in the second rotation direction.

3. The developing device according to claim 2, wherein the first rotation angle is greater than or equal to an angle from the second position to the third position in the second rotation direction.

4. The developing device according to claim 1, wherein the third rotation speed is slower than the first rotation speed.

5. The developing device according to claim 1, further comprising the toner carrying member configured to supply the toner to a photosensitive member in which an electrostatic latent image is formed on a surface thereof, to convert the electrostatic latent image into a manifest image.

6. An image forming apparatus comprising:

a photosensitive member in which an electrostatic latent image is formed on a surface thereof;

a developing device according to claim 1 configured to supply the toner to the photosensitive member, to convert the electrostatic latent image into a toner image as a manifest image; and a transfer portion configured to transfer, to a recording sheet, the toner image formed on the photosensitive member.

7. A method for controlling a developing device, the developing device including:

a developer carrying member rotatably supported and configured to rotate in a first rotation direction, thereby to carry a two-component developer on a surface thereof, to supply, at a first position, toner included in the two-component developer to a toner carrying member on a next stage, and further to cause the two-component developer carried on the surface to be detached therefrom at a second position on a downstream side in the first rotation direction relative to the first position; and a layer thickness regulating member provided, spaced from the surface of the developer carrying member, at a third position on an upstream side in the first rotation direction relative to the first position on an outer circumference of the developer carrying member, the layer thickness regulating member configured to regulate a thickness of a layer of the two-component developer carried by the developer carrying member rotating in the first rotation direction, the method comprising the steps of:

when a developing process is performed, causing the developer carrying member to rotate in the first rotation direction at a first rotation speed previously determined; and when the developing process is not performed, causing the developer carrying member to rotate at a second rotation speed faster than the first rotation speed in a second rotation direction reverse to the first rotation direction, and further causing the developer carrying member to rotate at a third rotation speed slower than the second rotation speed in the second rotation direction.

* * * * *